United States Patent [19]

Guntly et al.

[11] Patent Number: 5,070,829

[45] Date of Patent: Dec. 10, 1991

[54] PRIMER BULB RETAINER FOR CARBURETOR

[75] Inventors: Thomas G. Guntly, Hartford; Richard T. Anderson, Menomonee Falls, both of Wis.

[73] Assignee: Briggs & Stratton, Wauwatosa, Wis.

[21] Appl. No.: 590,350

[22] Filed: Sep. 28, 1990

[51] Int. Cl.[5] ..... F02M 1/16

[52] U.S. Cl. ..... 123/179.9; 92/92; 277/189; 261/DIG. 8

[58] Field of Search ..... 123/187.5 R; 261/DIG. 8; 92/92; 277/12, 181, 189

[56] References Cited

U.S. PATENT DOCUMENTS 4,197,825 4/1980 Altenbach ..... 123/187.5 R

*Primary Examiner*—Andrew M. Dolinar

*Attorney, Agent, or Firm*—Andrus, Sceales, Starke & Sawall

[57] ABSTRACT

The present invention discloses an engine primer bulb assembly having a base, a primer bulb and a retaining ring for securing the primer bulb to the base. The retaining ring is self-locking and provides a circumferential force against the bulb to seal it with the base to provide a primer chamber.

13 Claims, 1 Drawing Sheet

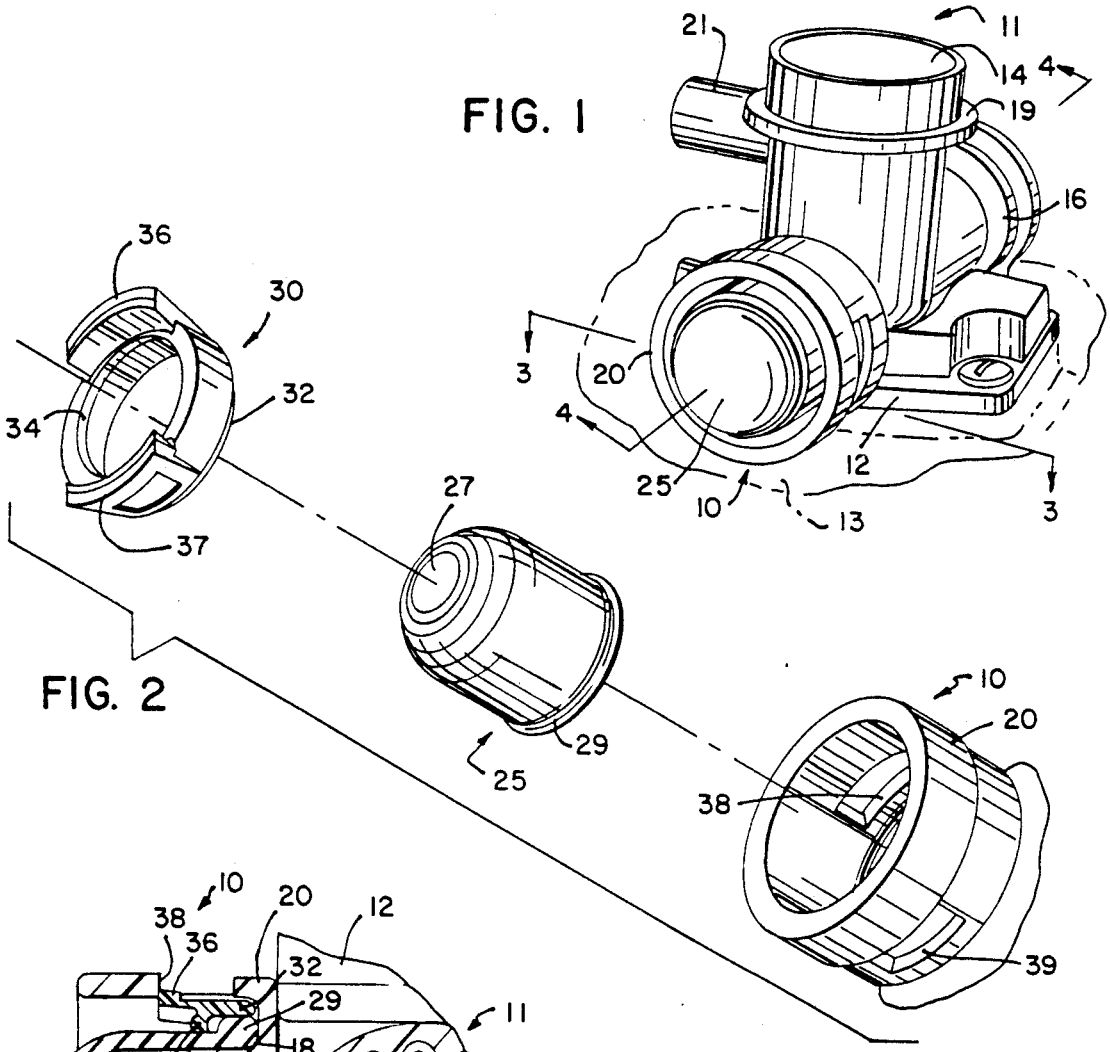
FIG. 1
FIG. 2
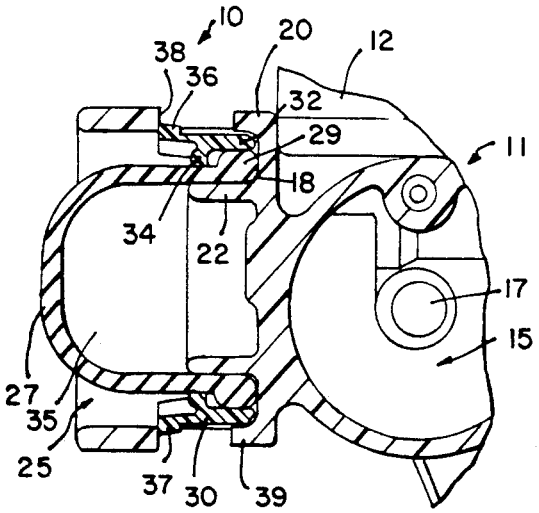
FIG. 3
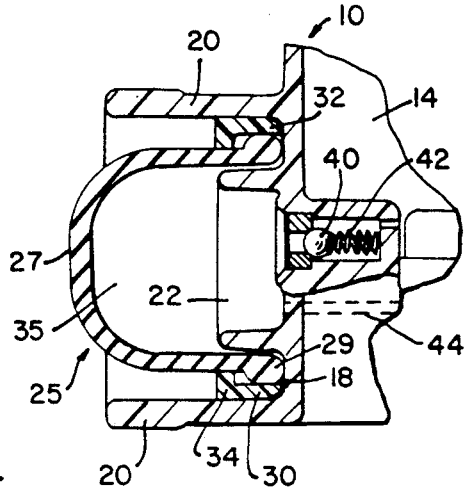
FIG. 4

PRIMER BULB RETAINER FOR CARBURETOR

BACKGROUND OF THE INVENTION

This application is related to the application for a Floatless Carburetor by Thomas G. Guntly et al and assigned to a common assignee, filed on even dated herewith, Ser. No. 07/590,014.

This invention relates generally to manually compressible priming bulb assemblies for supplying a priming charge of fuel to a carburetor for internal combustion engines, and more particularly to apparatus for sealing and retaining the bulb in the carburetor.

Small internal combustion engines, such as those used in snow blowers, lawn mowers and the like generally require fuel mixture enrichment when starting, particularly when cold. For example, in cold weather the cranking resistance increases due to weather sensitivity of such things as oil viscosity and the like, which can slow down the cranking speed of the engine during starting. This reduces the velocity and fuel intake and, in addition due to the cold, gasoline atomization is reduced, all causing the mixture in the combustion chambers to be leaner than desired. Choking systems associated with the carburetor to vary the air fuel mixture are well known and are often used to assist cold weather starting. It is also known to use primer devices to enrich the fuel mixture in lieu of or in combination with choking systems. Primers offer several advantages over choking, such as, by way of example, elimination of adjustment error, less cost associated with the manufacture of the engine and fewer moving parts, reducing the possibility of breakdown or malfunction. In same applications, the primer may be used to start the engine and a choking system may be used to operate the engine until running temperature is achieved, particularly in severe cold starting conditions.

Known priming devices are typically in the form of an operator actuated priming bulb which, when depressed, displaces fuel into the engine intake system. Dry primers first displace air into a fuel chamber to indirectly induce fuel into the intake of the engine. Wet primers are continuously filled with fuel and displace it directly into the intake of the engine when depressed.

The prior art devices have been of relatively complex design, see for example U.S. Pat. Nos. 4,679,534; 4,589,586; 4,197,825; 3,948,589; and U.S. Pat. No. 3,494,343. In particular, U.S. Pat. No. 4,404,933 discloses a primer device comprising a primer bulb that is fitted directly into a self-sealing base. As there shown, the primer bulb is a two-piece assembly with the bulb of resilient material including an integral annular mounting ring. The base is made of a stiff material having a channeled rim for receiving the annular ring on the primer bulb. The base is adapted to be wedged into a suitable receptacle in communication with the engine fuel system. U.S. Pat. No. 4,197,825 discloses an annular sealing member for attaching a primer bulb on the body of a float type carburetor. The bulb is maintained in an annular groove by the sealing member which is pressed against the primer bulb to provide an axial compression force on the annular flange of the bulb. U.S. Pat. No. 4,679,534 includes a channel provided in the carburetor body by an interior and exterior annular flange on the carburetor. The primer bulb is placed in the channel and is compressed axially into the channel by a retainer.

SUMMARY OF THE INVENTION

The primer bulb assembly of the present invention differs from the prior art by providing for a circumferential seal between the primer bulb and the carburetor body, increasing the integrity of the seal while reducing the required manufacturing tolerances to provide for a primer bulb device that is easy to assemble and relatively inexpensive to manufacture. The primer bulb may be easily removed for service or repair without destruction of the primer retainer.

The primer assembly of the present invention is a three-piece assembly with the primer bulb being mounted on a base provided on the carburetor and retained in place by a retaining ring which is releasably secured to the base. The retaining ring is made out of a semi-rigid material such that the normal shape may be deformed slightly or bent slightly in order to secure the bulb to the base.

The primer bulb is inserted into an annular o channel provided in the base. The channel includes an inner axially extending hoop or sealing surface for receiving and engaging the inside wall of the primer bulb. The primer bulb includes an integral, molded o-ring which provides a sealing relationship between the sealing surface of the carburetor and the bulb. The retaining ring fits over the bulb and into the channel provided in the carburetor to hold the bulb in place in the channel. The outer wall on the base includes a plurality of slots adapted to receive complementary detents provided on the ring thereby providing snap-lock The detents are adapted to be received in the slots in the outer wall for locking the ring, bulb and base in assembled relationship. The engagement of the detents in the slots holds the retainer in place creating a seal between the bulb inside diameter and the carburetor body by providing a circumferential force on the outside diameter of the primer bulb o-ring section. The circumferential seal between the bulb inside diameter and the sealing surface completely eliminates leakage. The detents may be manually retracted from the slots to facilitate disassembly of the ring and primer bulb from the base in the carburetor to accommodate service and repair.

The present invention provides for less costly assembly over primer devices of the prior art because of the ability to mechanize the assembly operation, providing for a design which includes fewer parts, each of which may be manufactured in a single molding process. The invention also provides for a primer bulb assembly with a more consistent and longer lasting seal by using a circumferential, o-ring seal design rather than the axially compressed seals of the prior art. O-ring technology is well known, and provides a superior seal longevity when compared to compression seal characteristics cf the axial compression design, with less sealing force required and less critical assembly techniques. The invention also provides for a primer bulb assembly which may be readily field assembled and disassembled for service and repair.

Other features of the invention will be readily apparent from the drawing and description of the preferred embodiment which follow.

BRIEF DESCRIPTION OF THE DRAWING

FIG. 1 is a perspective of the primer bulb assembly of the preferred embodiment.

FIG. 2 is an exploded perspective view of the primer bulb assembly of FIG. 1.

FIG. 3 is a cross-sectional view of the assembly taken generally along line 3—3 of FIG. 1.

FIG. 4 is a cross-sectional view of the assembly taken generally along line 4—4 of FIG. 1.

DESCRIPTION OF THE PREFERRED EMBODIMENT

As best shown in FIG. 2, the primer assembly of the preferred embodiment comprises a molded base 10 which is an integral part of a unitary floatless carburetor 11, a resilient primer bulb 25, and a retaining ring 30. The careburtor 11 includes a mounting base 12 (FIG. 1) for mounting the carburetor and primer bulb assembly on a fuel tank 13. As shown in FIG. 3, the fuel intake chamber 15 of the carburetor and includes an opening 17 which is in communication with the fuel tank at carburetor base 12. An air intake tube 14 is disposed above the fuel chamber and includes a annular flange 19 on which a typical air filter may be mounted. A positive crank case ventilation tube 21 is provided in communication with the fuel chamber between the base 12 and the air intake tube 14. At a right angle to the air intake tube and in communication with the mixing chamber is the induction tube or outlet 16 which is in direct communication with the fuel intake system of the engine for introducing the air fuel mixture into the engine. The base 10 for the primer bulb assembly is opposite the induction tube and in communication with the mixing chamber. In the preferred embodiment, the carburetor 11 is of a unitary molded construction and is made out of reinforced nylon or similar plastic material.

The primer base 10 is part of the unitary carburetor construction. As best shown in FIGS. 3 and 4, the base includes an annular channel 18 formed by the outer annular wall or shroud 20 and the inner annular sealing surface or wall 22. The primer bulb 25 is a resilient flexible bulb made of rubber or the like, and includes a rounded, closed dome 27 and an open enlarged rimmed or lipped end 29 which defines an integral o-ring on the outer open end of the bulb. The o-ring rim 29 is adapted to fit snugly over the inside annular wall 22 and into the channel 18 to define the primer chamber 35. The inside diameter of the open end of the primer bulb 25 is designed to fit snugly against the sealing surface wall 22 providing an annular or circumferential seal between the base of the carburetor and the primer bulb. The outer annular wall 20 extends beyond the inner wall 22 and shrouds all but the rounded tip 27 of the primer bulb protecting it against damage.

An annular retaining ring 30 is adapted to be inserted in the channel 18 between the outer wall 20 and the primer bulb 25. The ring 30 is molded from a semi-rigid material such as, by way of example, nylon or the like and defines a hoop for holding the bulb in place. The internal diameter at outer end 32 of the ring is adapted to fit between the enlarged o-ring rim 29 and the outer annular wall 20 of the base (FIG. 3). A snug tight fit is provided, thereby compressing the resilient rim 29 between the ring 30 and the inner annular wall 22 to provide a tight circumferential seal between the sealing surface of the inner wall 22 and the o-ring rim 29. The ring is designed to allow for slight deformation, if necessary, to provide evenly applied pressure about the entire periphery of the o-ring lip 20 of the bulb. An annular ridge 34 is provided on the inside wall of the ring 30 axially inward of the edge 32, whereby the bulb rim 29 is restrained against axial movement in the channel 18. The ridge 34 retains the bulb in the channel 18 and internal dimensions of the ring 30 provide for a tight fit between the bulb 25 and the interior annular wall 22.

The retaining ring 30 includes a pair of integral resilient detent tabs 36 and 37. The outer annular wall 20 of the primer assembly tube includes a pair of slots 38, 39 for receiving the detent tabs 36, 37, respectively. After the bulb 25 has been placed in the channel 18, the ring 30 is placed over the bulb and urged down into the channel, compressing the detents 36 and 37 as they enter the annular opening defined by the wall 20. When the ring is properly seated against the channel 18, the detents 36, 37 expand into slots 38, 39, respectively for retaining the bulb and ring on the mounting base.

As best shown in FIG. 4, the primer chamber 35 is in communication with the carburetor mixing chamber 15 through the ball and spring seat valve 40 and the through orifice 42. The primer chamber is also in communication with the fuel supply via integral passageway or tube 44. Typically, prior to starting the engine, the primer bulb is depressed. When the primer bulb is released, fuel is drawn from the fuel tank through the integral passageway or tube 44 and into the primer chamber 35. When the primer bulb is again depressed, the fuel in the primer chamber 35 is introduced into the mixing chamber via the ball and spring seat valve 40 and the orifice 42 to enrich the air fuel mixture to enhance starting the engine.

An important feature of the invention is the ability to disassemble the primer bulb system in the field. The detent tabs 36, 37 may be removed from the slots 38 and 39 by inserting a screwdriver or the like into the slots. The detents may be retracted from the slots and the ring withdrawn without destruction, permitting its reuse. This permits the retaining ring 30 to be withdrawn from the assembly to free the primer bulb 25 from the channel 18.

While specific features of the preferred embodiment have been disclosed herein, it will be understood that the invention encompasses all the enhancements and modifications of the attached claims.

We claim:

1. A primer assembly for an internal combustion engine for introducing an amount of fuel into an intake system prior to starting the engine, comprising:

a) a primer bulb comprised of a resilient material and including an enlarged annular outer rim;

b) a base for receiving the annular rim of said primer bulb; and c) a retaining ring adapted to be received by and secured to the base for engaging and sealing the rim of the primer bulb to the base for defining a primer chamber between the base and the primer bulb, said base includes a pair of concentric annular walls defining a channel therebetween, wherein the annular rim of the primer bulb is adapted to fit over the interior annular wall and into the channel, and wherein the retaining ring includes an annular outer end dimensioned to fit around the bulb and between the rim and the outer annular wall of the base, for urging the rim of the primer bulb into engagement with the inner annular wall.

2. The primer assembly of claim 1, wherein the retaining ring includes an integral self-locking means for securing the ring to the base.

3. The primer assembly of claim 1, the outer annular wall of the base including a pair of slots and the retaining ring including a pair of resilient tabs for defining detents which are received by the slots when the ring, bulb and base are fully assembled, thereby mechanically locking the assembly in assembled relationship.

4. The primer assembly of claim 3, the sealing ring further including a circumferential ridge spaced inwardly from the outer end of the ring and extending radially inward from the outer wall to provide a retainer against the rim of the primer bulb.

5. The primer assembly of claim 3 wherein said resilient tabs each include a tool-engaging portion selectively engageable by a tool for moving said tabs from their locked to their unlocked positions.

6. The primer assembly of claim 5 wherein said tool-engaging portion comprises a shoulder formed in said tabs and located adjacent said slots when the ring, bulb and base are in said assembled relationship.

7. A primer assembly for an internal combustion engine for introducing an amount of fuel into an intake system prior to starting the engine, comprising:

a) a primer bulb comprised of a resilient material and including an enlarged annular outer rim;

b) a base for receiving the annular rim of said primer bulb;

c) a retaining ring adapted to be received by and secured to the base for engaging and sealing the rim of the primer bulb to the base for defining a primer chamber between the base and the primer bulb; and d) snap-lock mans cooperable between said ring and said base for securing the ring to the base.

8. The primer assembly of claim 7 wherein said snap-lock means includes at least one resilient tab on one of said base and ring and an abutment on the other of said base and right for engagement with said tab.

9. The primer assembly of claim 7, wherein the base includes a pair of concentric annular walls defining a channel therebetween, wherein the annular rim of the primer bulb is adapted to fit over the interior annular wall and into the channel, and wherein the retaining ring includes an annular outer end dimensioned to fit around the bulb and between the rim and the outer annular wall of the base, for urging the rim of the primer bulb into engagement with the inner annular wall.

10. The primer assembly of claim 9, wherein said snap-lock means includes a pair of slots formed in the outer annular wall of the base and a pair of resilient tabs formed in the retaining ring for defining detents which are received by the slots when the ring, bulb and base are fully assembled, thereby mechanically locking the assembly in assembled relationship.

11. The primer assembly of claim 10, the sealing ring further including a circumferential ridge spaced inwardly from the outer end of the ring and extending radially inward from the outer wall to provide a retainer against the rim of the primer bulb.

12. The primer assembly of claim 10 wherein said resilient tabs each include a tool-engaging portion selectively engageable by a tool for moving said tabs from their locked to their unlocked positions.

13. The primer assembly of claim 12 wherein said tool-engaging portion comprises a shoulder formed in said tabs and located adjacent said slots when the ring, bulb and base are in said assembled relationship.

* * * * *

UNITED STATES PATENT AND TRADEMARK OFFICE

CERTIFICATE OF CORRECTION

PATENT NO. : 5,070,829

DATED : December 10, 1991

INVENTOR(S) : Thomas G. Guntly et al

It is certified that error appears in the above-identified patent and that said Letters Patent is hereby corrected as shown below:

| | |
|---|---|
| CLAIM 8, Column 6, Line 2 | Delete "right" and stubstitute therefore --- ring --- |

Signed and Sealed this

Twenty-third Day of March, 1993

*Attest:*

STEPHEN G. KUNIN

*Attesting Officer*

*Acting Commissioner of Patents and Trademarks*